United States Patent [19]

Kim

[11] 4,205,493

[45] Jun. 3, 1980

[54] PORTABLE CHAMFERING GRINDING DEVICE

[76] Inventor: Myung S. Kim, 272 Taft St., Windgap, Pa. 18091

[21] Appl. No.: 886,544

[22] Filed: Mar. 14, 1978

[51] Int. Cl.[2] ..... B24B 23/02; B23B 5/16

[52] U.S. Cl. ..... 51/170 T; 51/73 R; 408/291; 408/227

[58] Field of Search ..... 51/170 R, 170 T, 241 R, 51/241 S, 241 VS, 73 R, 204, 209 R; 144/205; 82/4 C; 408/211, 227, 207

[56] References Cited

U.S. PATENT DOCUMENTS

| | | | |
|---|---|---|---|
| 1,946,416 | 2/1934 | Seiler | 29/78 |
| 2,133,612 | 10/1938 | Gallivan | 51/241 VS |
| 2,363,102 | 11/1944 | Wachowitz | 51/204 |
| 2,760,313 | 8/1956 | Harvey | 51/209 R |
| 2,922,218 | 1/1960 | Lewis | 29/78 |
| 3,168,799 | 2/1965 | Johnson | 51/392 |
| 3,228,268 | 1/1966 | Strout | 408/211 |
| 3,335,526 | 8/1967 | Weiss | 51/241 R |
| 3,754,832 | 8/1973 | Stickler | 408/227 |
| 3,817,649 | 6/1974 | Medney | 408/211 |
| 3,896,593 | 7/1975 | Rine | 51/209 R |
| 3,976,388 | 8/1976 | Webb | 408/211 |
| 4,037,367 | 7/1977 | Kruse | 51/209 R |

FOREIGN PATENT DOCUMENTS

| | | | |
|---|---|---|---|
| 337424 | 5/1959 | Switzerland | 51/204 |

*Primary Examiner*—Othell M. Simpson
*Assistant Examiner*—Roscoe V. Parker
*Attorney, Agent, or Firm*—Roylance, Abrams, Berdo & Farley

[57] ABSTRACT

A portable chamfering grinding device for chamfering the end of a metal tube comprising an abrasive wheel and a portable pneumatic motor capable of rotating the wheel at greater than 10,000 r.p.m., the wheel including a diverging frustoconical portion having an inner grinding surface at an angle of about 37.5° to the axis of the wheel for receiving and grinding the end of the metal tube. The inner grinding surface has eight raised, substantially trapezoidal grinding portions thereof to provide cutting edges and reduce shaking and slipping during grinding of the metal tube end.

7 Claims, 5 Drawing Figures

PORTABLE CHAMFERING GRINDING DEVICE

BACKGROUND OF THE INVENTION

The present invention relates to a portable chamfering device for chamfering the end of a metal tube, and more particularly, it relates to a device comprising an abrasive wheel and a portable pneumatic motor coupled to the wheel and capable of rotating the wheel at greater than 10,000 r.p.m., which device is especially useful to chamfer steel tubes which are fixed in place and are in confined spaces so as to prepare these tubes for welding.

In the construction, repair and maintenance of large equipment which utilize thick-walled steel tubes, such as boilers, it is often necessary to replace or install a section of tubing. This is usually done by welding the ends of the section to two other parts of the tubing which is fixed in place. In order to form a proper weld connection, the ends of the tubes to be connected must be chamfered.

This chamfering must be done accurately and at the ASTM recommended angle of 37.5° so that the weld is successfully accomplished. It also must be done quickly due to high wages paid to the machinist doing the work and a welder who is usually standing by to do the welding. Moreover, this chamfering usually must be done in a confined space in the region of the boiler where the tubes are fixedly located.

In the prior art, various devices have been utilized to provide a chamfer at the end of metal tubes for preparation for welding; however, they all have various drawbacks which make them unsuitable to do the activity set forth above. Thus, some are very bulky and therefore can not be maneuvered into confined spaces. Other prior art devices utilize disc-shaped grinding stones; however, these take an extremely long time to perform the chamfering and they are not very accurate. Other devices utilize very heavy stone grinding wheels; however, because of their heaviness, they cannot be held by a machinist for long periods of time and accordingly, the chamfering takes significantly more time since the machinist must rest periodically. In addition, these heavy stone grinding wheels cannot be rotated at very high speeds and therefore chamfering with them takes an exceedingly long time. Moreover, various prior art devices utilize metal blades; however, they frequently break at high speeds and require significant amounts of time in replacing these broken blades.

SUMMARY OF THE INVENTION

Accordingly, it is an object of the present invention to provide a chamfering grinding device which is portable so that it can be utilized in confined spaces where the tubes to be chamfered are rigidly fixed.

It is another object to provide a chamfering grinding device which provides a chamfer at the proper angle so as to assure a viable weld to the tubes being chamfered.

Another object is to provide a chamfering grinding device which is capable of extremely high rotation so as to perform the chamfering quickly.

Another object is to provide a portable chamfering grinding device which is very light and therefore can be held by a machinist for an extended period of time.

A further object is to provide a chamfering grinding device having raised portions to prevent shaking and slipping of the device at extremely high speeds.

Another object is to provide a chamfering grinding device which is very strong and will not break at high speeds.

The foregoing objects are attained by providing a portable grinding device for chamfering the end of a metal tube comprising a wheel formed of abrasive particles adhered together, the wheel comprising a flat, circular base and a frustoconical portion having the smaller end thereof extending from the periphery of the base; portable rotation means for rotating the wheel at a speed of at least 10,000 r.p.m.; and means for connecting the base to the rotation means, said frustoconical portion having an inner grinding surface at an angle of about 37.5° relative to the axis of the circular base, the grinding surface receiving therein in contacting relationship the end of the metal tube to chamfer that end.

In addition, a plurality of raised portions of substantially trapezoidal shape extend in spaced relation on the inner grinding surface to provide cutting edges during grinding and to reduce shaking and slipping during the grinding operation.

Because the grinding wheel is formed of abrasive particles, it is extremely strong and will not break. Moreover, it can be operated at extremely high rotational speeds, i.e., over 10,000 r.p.m. so that the grinding operation can be quickly completed.

Moreover, since the inner grinding surface is at an angle of about 37.5°, a very accurate chamfer is provided to the metal tubes so as to provide a viable weld to the two tubes to be connected.

Since the device comprises a wheel and a portable rotation means, such as a pneumatic motor, it is very light in weight and very maneuverable, so that a machinist can utilize it for a long period of time in confined spaces.

Other objects, advantages and salient features of the present invention will become apparent from the following detailed description, which, taken in conjunction with the annexed drawings, discloses a preferred embodiment of the present invention.

DRAWINGS

Referring now to the drawings which form a part of this original disclosure:

Figure 4:
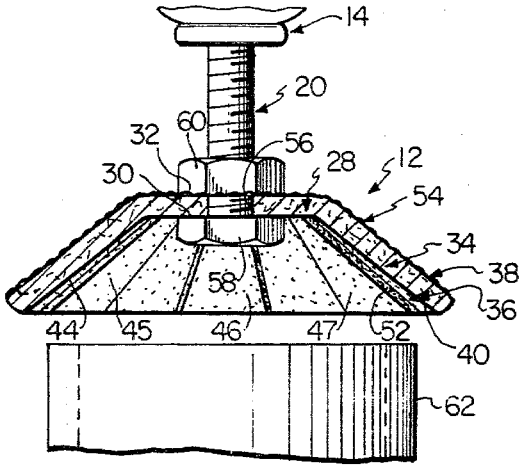
Figure 5:
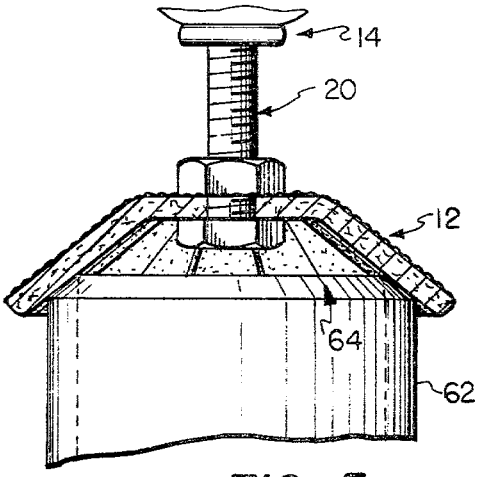

FIG. 4 is a vertical sectional view of the device in accordance with the present invention including part of the portable pneumatic motor, the grinding wheel, and the means for coupling them together, as well as the end of a tube about to be moved into contact with the inner grinding surface of the wheel; and FIG. 5 is a vertical sectional view similar to that shown in FIG. 4, but with the steel tube having been chamfered by the grinding device of the present invention and with the steel tube in contact with the inner grinding surface of the grinding device.

DETAILED DESCRIPTION OF THE INVENTION

Figure 1:
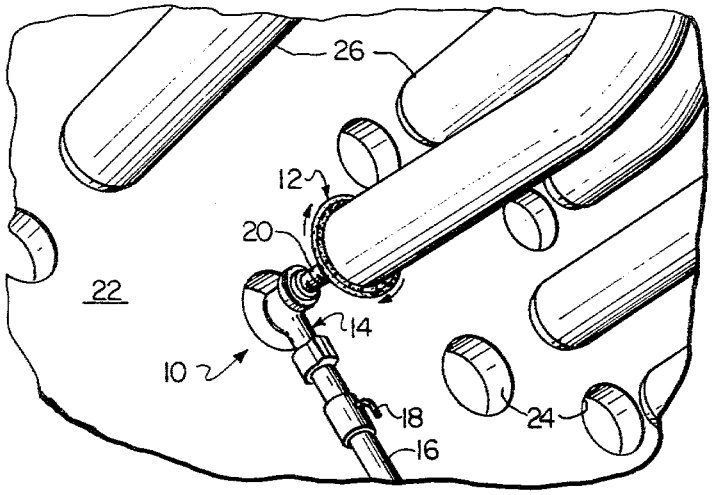
FIG. 1 is a perspective view of a portable grinding device in accordance with the present invention in operation chamfering the ends of steel tubes fixedly located adjacent the wall of a boiler.

Referring now to FIG. 1, the portable grinding device 10 of the present invention is shown comprised of the abrasive grinding wheel 12 coupled to a portable pneumatic motor 14 which has a source, not shown, of compressed air at approximately 60–100 p.s.i. The compressed air is delivered to the motor 14 via tubing 16 and is regulated into the motor via trigger 18. A rod 20 couples the grinding wheel 12 to the pneumatic motor 14.

As shown in FIG. 1, there is a wall 22, which could be the wall of a boiler, having a plurality of orifices 24 therein and a plurality of previously cut tubes 26 adjacent these orifices. It is the ends of these tubes 26 which are to be chamfered so that additional sections of tubes can be maneuvered through the orifices 24 and then welded to the ends of the tubes 26.

As used herein, a "tube" is meant to mean a thick-walled metal, cylindrical pipe, with a typical wall thickness of ⅜-inch and an inner diameter of 2 inches, the metal typically being carbon steel.

Figure 2:
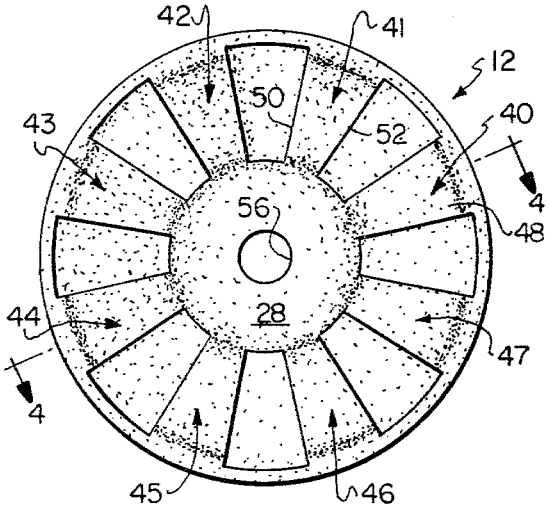
FIG. 2 is a bottom plan view of the abrasive grinding wheel of the present invention showing the substantially trapezoidal raised portions on the inner grinding surface thereof.
Figure 3:
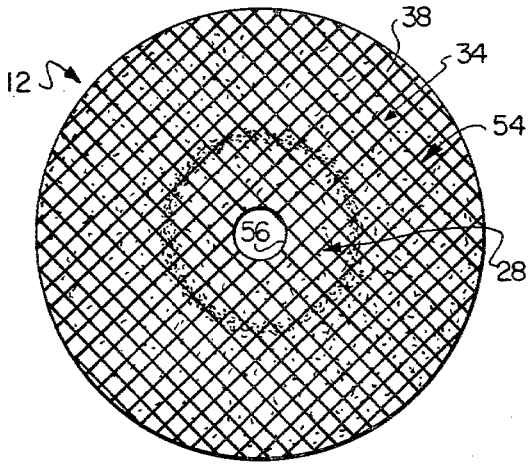
FIG. 3 is a top plan view of the abrasive grinding wheel of the present invention showing the fiberglass web on the outer surface thereof.

Referring now to FIGS. 2, 3 and 4, the abrasive grinding wheel 12 is shown as comprising a flat circular base 28 having an inner surface 30 and an outer surface 32, and a frustoconical portion 34 having the smaller end thereof extending from the periphery of the base. This frustoconical portion 34 has an inner grinding surface 36 at an angle of about 37.5° relative to the axis of the circular base. The frustoconical portion 34 has an outer surface 38.

The inner grinding surface 36 includes eight substantially trapezoidal, raised portions 40–47, which are equally spaced around the inner grinding surface 36 and have their smaller ends adjacent the inner surface 30 of the base 28. These substantially trapezoidal raised portions extend from the base to the end of the frustoconical portion 34.

As seen in FIG. 2, each raised portion has a flat top surface 48 and two flat side surfaces 50 and 52 with each of the flat side surfaces forming at 90° angle with each of the flat side surfaces thereby forming cutting edges at the respective intersections thereof. The base 28 and the frustoconical portion 34 in the area of these trapezoidal raised portions 40–47 are substantially the same thickness in cross-section.

Embedded in the outer surface 38 of the frustoconical portion 34 and the outer surface 32 of the circular base 28 is a fiberglass web 54, which adds strength to the grinding wheel 12.

The abrasive particles forming the grinding wheel are preferably grinding stone particles A24 and these particles are preferably adhered together by means of a heat cured resin, which is conventional. This wheel is constructed by means of a conventional mold and dye operation in which heat is applied for about 24 hours, this heat being maintained at about 180° C.

Coupling the pneumatic motor 14 to the grinding wheel 12 is threaded rod 20, which is suitably rigidly supported in the pneumatic motor 14 and which extends through a central aperture 56 in the base 28 of the wheel 12, the rod 20 having an enlarged head 58 on the end thereof below the inner surface 30 of base 28 and a nut 60 threadably engaged on the rod 20 and positioned adjacent the outer surface 32 of the circular base 28.

As shown in FIG. 4, the outer periphery of the inner grinding surface 36 is slightly larger than the outside diameter of steel tube 62 which is to be chamfered.

OPERATION

In operation, the pneumatic motor 14 is connected to a suitable source of compressed air at approximately 60–100 p.s.i. so that the pneumatic motor can deliver over 10,000 r.p.m. to the abrasive grinding wheel 12 attached thereto. Preferably, the grinding wheel can be operated over 10,000 r.p.m. up to 18,000 r.p.m., with 12,000 r.p.m. being preferred.

Once the grinding wheel 12 is coupled to the pneumatic motor 14, and the motor is supplied with its compressed air, the operator of the device 10 maneuvers it into a position so that the central axes of the steel tube 62 and rod 20 are aligned and the end of the steel tube is in contact with the inner grinding surface 36.

At this time, the trigger 18 is depressed, which results in high speed rotation of the grinding wheel. The grinding wheel 12 is then pressed against the end of the steel tube and this operation is continued until the required chamfer is formed at the end of the tube, as seen in FIG. 5.

The chamfer is shown in FIG. 5 by the character numeral 64 and has the desirable 37.5° angle so as to provide a viable weld with an additional tube having a similar chamfer.

As seen in FIG. 1, the entire device 10 can be maneuvered into a very confined space, yet a quick and accurate chamfer can be supplied to the tubes shown therein.

Moreover, since the grinding wheel 12 has the plurality of substantially trapezoidal raised portions 40–47, the high speed rotation of over 10,000 r.p.m. can be maintained while shaking of the device and slipping of the wheel relative to the tube is greatly reduced. Furthermore, the intersecting top surfaces and side surfaces of each trapezoidal raised portion provides a cutting edge to the inner grinding surface of the wheel, so that the entire chamfering operation is performed in a shorter period of time.

As an example of the advantages of the present invention, it has been found that utilizing a flat disc in combination with a pneumatic motor at 12,000 r.p.m., on ⅜-inch wall tubes having 2-inch inner diameters and being formed of carbon steel requires one to one and one-half hours work to provide a chamfer and requires the use of two or three such flat discs. On the other hand, utilizing the present invention, a desired chamfer was accomplished within 15 minutes and only one grinding wheel was necessary.

While a preferred embodiment has been chosen to illustrate the invention, it will be understood by those skilled in the art that various changes and modifications can be made therein without departing from the scope of the invention as defined in the appended claims.

What is claimed is:

1. A portable grinding device for chamfering the end of a metal tube comprising:

a rigid, molded wheel formed of abrasive particles adhered together, said wheel comprising a flat, circular base and a frustoconical portion having the smaller end thereof extending from the periphery of said base;

portable rotation means for rotating said wheel at a speed of at least 10,000 r.p.m.; and means for connecting said base to said rotation means, said frustoconical portion having an inner grinding surface at an angle of about 37.5° relative to the axis of said circular base, said inner grinding surface receiving therein, in contacting relationship, the end of the metal tube to chamfer that end, said inner grinding surface including a plurality of equally, circumferentially spaced solid raised portions integrally formed with said frustoconical portion, each of said raised portions having a flat top surface and two flat side surfaces, said flat top surface intersecting with each of said two flat side surfaces;

the cross-sectional thickness of said frustoconical portion being greater in the areas of said solid raised portions than in the areas devoid of such solid raised portions.

2. A portable grinding device according to claim 1 wherein said raised portions are substantially trapezoidal in shape and extend from said base to the end of said frustoconical portion.

3. A portable grinding device according to claim 2 wherein said trapezoidal raised portions have their smaller ends adjacent said base.

4. A portable grinding device according to claim 2 wherein said inner grinding surface includes eight of said trapezoidal raised portions.

5. A portable grinding device according to claim 1 wherein each of said flat top surfaces in said raised portions forms a 90° angle with each of said flat side surfaces intersecting therewith.

6. A portable grinding device according to claim 1 wherein said base and said frustoconical portion in the area of said trapezoidal raised portions are substantially the same in cross-sectional thickness.

7. A portable grinding device according to claim 1 wherein said rotation means comprises a pneumatic motor.

* * * * *